US010527063B2

(12) United States Patent
Alban et al.

(10) Patent No.: US 10,527,063 B2
(45) Date of Patent: Jan. 7, 2020

(54) MOTOR COMPRESSOR UNIT WITH REMOVABLE CARTRIDGE

(71) Applicant: Thermodyn Sas, Le Creusot (FR)

(72) Inventors: Thomas Alban, Le Creusot (FR); Pierre Laboube, Le Creusot (FR); Patrick Friez, Le Creusot (FR)

(73) Assignee: Thermodyne SAS, LeCreusot (FR)

( * ) Notice: Subject to any disclaimer, the term of this patent is extended or adjusted under 35 U.S.C. 154(b) by 234 days.

(21) Appl. No.: 14/347,733

(22) PCT Filed: Sep. 25, 2012

(86) PCT No.: PCT/EP2012/068894
§ 371 (c)(1),
(2) Date: Mar. 27, 2014

(87) PCT Pub. No.: WO2013/045459
PCT Pub. Date: Apr. 4, 2013

(65) Prior Publication Data

US 2014/0234136 A1 Aug. 21, 2014

(30) Foreign Application Priority Data

Sep. 27, 2011 (FR) ..... 11 58638

(51) Int. Cl.
*F04D 29/60* (2006.01)
*F04D 29/42* (2006.01)
(Continued)

(52) U.S. Cl.
CPC ..... *F04D 29/601* (2013.01); *F04D 17/122* (2013.01); *F04D 25/02* (2013.01);
(Continued)

(58) Field of Classification Search
CPC ..... F04D 29/601; F04D 25/0606; F04D 29/4206; F04D 17/122; F04D 29/644; F04D 25/02; F04D 29/624; F16C 19/525
(Continued)

(56) References Cited

U.S. PATENT DOCUMENTS 2,291,346 A * 7/1942 Robinson ..... F04D 29/126 310/51
3,000,543 A * 9/1961 Paul ..... B64D 37/16 222/333

(Continued)

FOREIGN PATENT DOCUMENTS

EP 1473462 A1 11/2004
EP 1826887 A2 8/2007
EP 1830070 A2 9/2007

OTHER PUBLICATIONS

International Search Report and Written Opinion dated Jan. 31, 2013 which was issued in connection with PCT Application No. PCT/EP12/068894 which was filed on Sep. 25, 2012.

*Primary Examiner* — Charles G Freay
(74) *Attorney, Agent, or Firm* — Baker Hughes Patent Organization

(57) ABSTRACT

A motor compressor unit including a common housing sealed with respect to a gas to be compressed, a motor mounted to the common housing, and a compressor mounted to the common housing. The motor is mounted in an inner casing fastened in the common housing by at least one removable fastening device such that the motor and the inner casing form a removable cartridge.

14 Claims, 2 Drawing Sheets

(51) Int. Cl.

| | |
|---|---|
| ***F04D 29/64*** | (2006.01) |
| ***F04D 17/12*** | (2006.01) |
| ***F04D 25/06*** | (2006.01) |
| ***F04D 25/02*** | (2006.01) |
| ***F04D 29/62*** | (2006.01) |

(52) U.S. Cl.
CPC ..... *F04D 25/0606* (2013.01); *F04D 29/4206* (2013.01); *F04D 29/624* (2013.01); *F04D 29/644* (2013.01)

(58) Field of Classification Search
USPC ..... 417/360, 423.12; 384/493, 557
See application file for complete search history.

(56) References Cited

U.S. PATENT DOCUMENTS 3,185,099 A * 5/1965 Spring ..... F04D 13/06 248/606
3,426,690 A * 2/1969 Cattabiani ..... F04D 7/06 310/88
3,604,820 A * 9/1971 Scheller ..... F04D 29/628 310/91
3,826,597 A 7/1974 Schmitz
4,115,038 A * 9/1978 Litzenberg ..... H02K 5/128 415/912
4,184,472 A * 1/1980 Benedicto ..... B26D 3/28 125/23.01
4,648,789 A * 3/1987 Bowman ..... F01C 19/12 277/638
4,961,260 A 10/1990 Ferri et al.
5,117,138 A 5/1992 Trian
5,354,182 A * 10/1994 Niemiec ..... F01C 21/007 248/638
5,354,187 A * 10/1994 Holland ..... B60T 8/368 138/31
5,538,406 A * 7/1996 Siegal ..... F04D 29/086 417/360
5,618,166 A * 4/1997 Legett ..... F04D 7/08 417/313
5,627,420 A 5/1997 Rinker et al.
5,971,702 A 10/1999 Afton et al.
6,196,809 B1 * 3/2001 Takahashi ..... F04D 25/16 415/209.2
6,254,360 B1 * 7/2001 Sato ..... B60S 1/481 417/360
6,386,845 B1 * 5/2002 Bedard ..... F04D 29/083 417/363
6,474,960 B1 * 11/2002 Hansmann ..... A61M 16/0057 415/196
6,860,466 B2 * 3/2005 Sakurai ..... F02D 11/10 251/129.11
7,458,214 B2 12/2008 Philippe
2006/0123783 A1 6/2006 Philippe
2006/0157027 A1 * 7/2006 Ichikawa ..... F02D 9/105 123/399
2006/0181168 A1 * 8/2006 Hargraves ..... F04B 17/03 310/90
2006/0220473 A1 * 10/2006 Ueda ..... H02K 33/16 310/12.25
2006/0228238 A1 * 10/2006 Andrews ..... F04D 13/06 417/423.1
2007/0084439 A1 * 4/2007 Isogai ..... F16K 1/221 123/399
2007/0086903 A1 * 4/2007 Schopperle ..... F04D 29/4293 417/360
2007/0257569 A1 * 11/2007 Heyder ..... F16F 1/326 310/66
2008/0087018 A1 * 4/2008 Woollenweber ..... F01D 25/16 60/605.3
2009/0162226 A1 * 6/2009 Campbell ..... F04D 29/4226 417/423.14
2009/0196764 A1 8/2009 Fogarty et al.
2011/0002799 A1 * 1/2011 McVicker ..... F04D 13/10 417/410.1

* cited by examiner

--PRIOR ART--

MOTOR COMPRESSOR UNIT WITH REMOVABLE CARTRIDGE

BACKGROUND OF THE INVENTION

Embodiments of the present invention relate to a high-speed electric motor of the integrated type, and more specifically to a high-speed motor compressor or turbo-compressor unit of the integrated type with a removable cartridge.

A high-speed motor is a motor whose rotation frequency is greater than the frequency of the electrical power network. A high-speed motor typically has a rotation speed of more than 3600 r.p.m.

A conventional integrated motor compressor unit is shown in part in FIG. 1. It comprises a sealed housing C in which are mounted an electric motor M and a compressor unit which is not shown, for example a multiple stage unit, which includes a plurality of compression impellers carried on an output shaft coupled to a rotor driven by the motor M.

The housing C, sealed by a cover T, has a first casing $E_C$ for containing the compressor, assembled together with a second casing $E_V$ in which the electric motor M is mounted. The electric motor M has a rotor R, a stator S, and first and second bearings $P_1$ and $P_2$ supporting the motor shaft, which are mounted, respectively, on a first and a second bearing support $SP_1$ and $SP_2$ positioned at either end of the rotor R.

The bearing supports $SP_1$ and $SP_2$ are mounted directly on the second casing $E_V$. In this arrangement, the second support $SP_2$ impedes access to the rotor R, and the first support $SP_1$ can only be accessed by removing the first casing $E_C$ from the second casing $E_V$.

The stator S of the motor M is shrink-fitted directly on to the motor casing $E_V$, and therefore cannot be removed. The motor casing $E_V$ comprises a high-voltage wiring outlet O formed in a sealed way on a radial part of the housing C. This high-voltage outlet O is usually non-removable.

Removable cartridge systems are generally used by manufacturers of compressors and pumps. For example, in a compressor with a removable cartridge, the aerodynamic stator parts and the rotor are combined in a cartridge having a cylindrical outer shape which can be fitted into the main housing enabling the pressure to be adjusted. The bearings may be external to this cartridge or may be attached to the ends of the cartridge.

Various prior art documents relate to such arrangements.

U.S. Pat. No. 3,826,597 describes the use of a concept of this type in specific rotating machine applications such as vane-type compressors.

U.S. Pat. Nos. 5,971,702 and 4,961,260 describe principles of cartridge centring and insertion for centrifugal compressor applications.

With regard to the application of this concept to electrical machines, the U.S. Pat. Nos. 5,117,138 and 5,627,420 describe a removable electric motor stator. However, this patent is concerned with submersible pump applications. Furthermore, the removable stator is encapsulated in order to isolate it from the process gas, and the bearings are completely separated from this stator.

Finally, the U.S. Pat. No. 7,458,214 relates to a turbocharger application composed of a turbine wheel and a compressor wheel mounted in a projecting manner, and equipped with an auxiliary electric motor with a removable stator.

In the last three documents, the stator is not encapsulated, and in U.S. Pat. No. 7,458,214 the bearings are always separated from the stator.

BRIEF DESCRIPTION OF THE INVENTION

In view of the above considerations, it is proposed that the drawbacks of prior art integrated motor compressor units be overcome by proposing a motor compressor unit comprising a cartridge which includes the whole of the stator, the bearings and the rotor, and which can easily be removed from the housing to facilitate the maintenance thereof.

According to one aspect, a motor compressor unit is proposed, comprising a motor, a compressor and a common housing sealed with respect to the gas to be compressed, in which the motor and compressor are mounted.

The motor is mounted in an inner casing fastened in the housing by removable fastening means such that the motor and inner casing form a removable cartridge.

The combination of the motor and inner casing into a removable cartridge facilitates the removal of the whole motor without the need to remove other elements of the motor compressor such as, notably, the coupling between the outer casing of the motor and the casing of the compressor, in cases where the housing is composed of a compressor casing and an outer motor casing.

Furthermore, since the motor is entirely assembled into a removable cartridge, it is possible to propose the use of a housing comprising a compressor casing and an outer motor casing. It is possible for the housing to be composed of a single casing into which the inner casing containing the motor is inserted. In this case, the elimination of a vertical coupling plane between the compressor casing and the outer motor casing reduces the risk of leakage due to the ageing of the joints at this coupling, and reduces the production cost because of the elimination of the joints and the associated grooves.

Furthermore, since all the elements of the motor are contained in the inner casing, access to all the motor components is facilitated.

The stator of the motor may be integral with the inner casing of the motor. Shrink-fitting the stator on to the inner casing, and more particularly on to the inner surface of the inner casing, causes the stator to be immobilized with respect to the inner casing on the one hand, and with respect to the housing on the other hand, once the inner casing has been fastened to the housing.

The motor compressor unit may comprise a key member between the inner casing and the housing, by means of which the inner casing is fixed to the housing, the motor torque is recovered and any rotation of the inner casing inside the housing is prevented.

The housing may comprise a shoulder on which one end of the inner casing, facing the compressor, bears.

The housing may comprise a first bearing support for the motor, said first support being fastened to one end of the inner casing facing the compressor. The first bearing support can be fixed by screwing on to the inner casing without any play, in such a way that the removable cartridge comprises the first bearing support, which can thus be withdrawn together with the removable cartridge.

The housing can comprise a second bearing support for the motor, said second support being fastened to one end of the inner casing opposite the end facing the compressor, by means of a semi-rigid link which can compensate for the relative expansion between the inner casing and the second bearing support.

In a first and a second embodiment, the motor compressor unit comprises a cover which can seal the housing at an end through which the inner casing is inserted into the housing, the cover being fastened to the second bearing support by screwing.

In the first embodiment, the inner casing is held in position axially by keying to the housing at one end through which the inner casing is inserted into the housing. The second bearing support and the cover are axially retained by means of a ring (Circlip®) inserted into a groove formed in the housing. The removable cartridge can be extracted from the housing by simply withdrawing the key member, and in this case the removable cartridge comprises the inner casing and its contents, the second bearing support, and the cover.

In the second embodiment, the second support is fastened to said housing at the end through which the inner casing is inserted into the housing. In this second embodiment, the removable cartridge can be extracted from the housing by simply detaching the second bearing support from the housing, without detaching the second bearing support, to which the cover is fastened, from the inner casing.

In the first and second embodiments, the cover can comprise a sealed axial high-voltage wiring outlet.

Additionally, in the first and second embodiments, the cover can comprise an axial gas supply inlet.

In a third embodiment, the motor compressor unit can comprise a cover which can seal the housing at an end through which the inner casing is inserted into the housing, the cover being fastened to the housing by screwing. In this embodiment, the removable cartridge can be extracted from the housing by simply detaching the cover from the housing.

In this third embodiment, the housing can comprise a sealed radial high-voltage wiring outlet passing through the inner motor casing and the housing.

In this third embodiment, the housing can also comprise a radial gas supply inlet passing through the outer motor casing and the housing.

In various embodiments, the compressor can comprise a plurality of compression stages.

BRIEF DESCRIPTION OF THE DRAWINGS

Other advantages and features of the invention will be made clear by the detailed description of embodiments which are not in any way limiting, and the attached drawings, in which.

DETAILED DESCRIPTION OF THE EXEMPLARY EMBODIMENTS OF THE INVENTION

Figure 1:
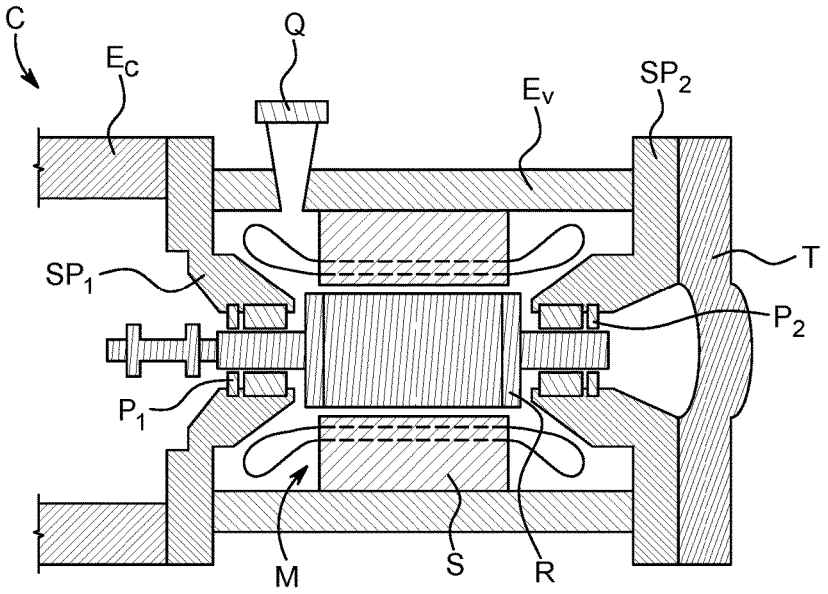
FIG. 1 shows part of an integrated motor compressor unit including the motor according to the prior art.
Figure 2:
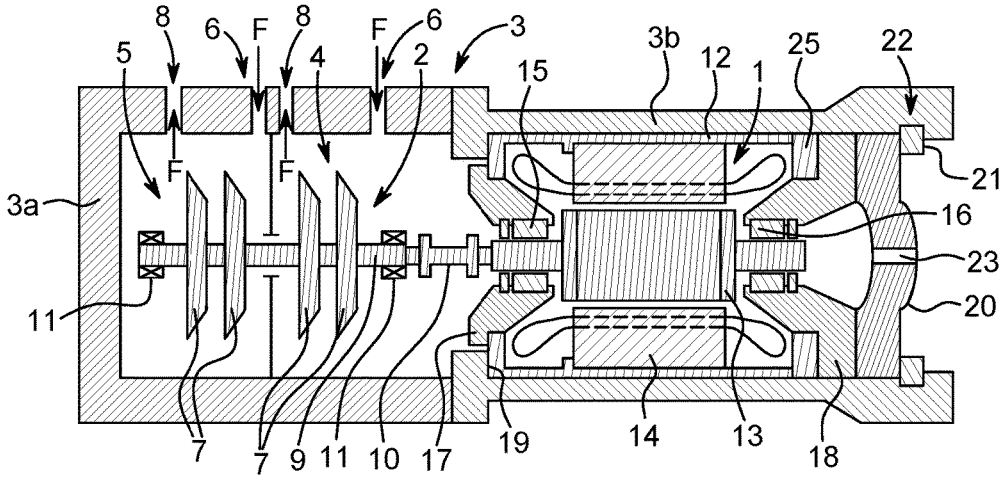
FIG. 2 shows a motor compressor unit with a removable cartridge according to one embodiment of the present invention.

FIG. 2 shows a motor compressor unit with a removable cartridge according to a first embodiment.

The whole of the motor compressor unit, and in particular, the motor 1 and the compressor unit 2, is mounted in a common housing 3 which is sealed with respect to the internal gas handled by the compressor. In the illustrated example, the common housing 3 comprises an assembly of housings 3*a* and 3*b* which are fixed together and which support and protect the compressor 2 and the motor 1, respectively. The housings 3*a* and 3*b* are fixed together by appropriate fastening means (not shown) enabling the housings to be fastened to each other in a rigid and sealed way. The common housing 3 may also be made in one piece.

In this case, the compressor unit 2 comprises a first compression stage 4 and a second stage 5. Each of the compression stages 4 and 5 comprises impellers 7 which compress the incoming gas delivered at the inlet by a gas inlet opening 6 formed in the housing 3*a*, while an outlet opening 8 collects the processed gas. An arrow F indicates the direction of the flow of the gas. The impellers 7 are mounted on an output shaft 9 coupled to the motor 1 via a coupling piece 10. The output shaft 9 is kept in position with the aid of two radial bearings 11 mounted, one on each end of the output shaft 9.

The motor 1 includes a rotor 13, a stator 14 and two bearings 15 and 16, mounted, respectively, on a first support 17 and a second support 18 at either end of the rotor 13. The assembly is mounted in a cylindrical inner casing 12 mounted removably with respect to the housing 3*b*.

The stator 14 is shrink-fitted on to the inner surface of the inner casing 12 in such a way that it is integral with the inner casing 12. A key member between the inner casing 12 and the housing 3*b* is used to recover the motor torque and prevent any rotation of the stator 14.

The bearings 15 and 16 provide radial support for the rotor 13. In this first exemplary embodiment, the first bearing 15 is mounted on the first support 17, which is itself fastened to one end of the inner casing 12 facing the compressor 2. The second bearing 16 is mounted on the second support 18, which is fastened to one end of the inner casing 12 opposite the end facing the compressor 2 by means of a semi-rigid link 25 enabling the axial expansion of the inner casing 12 to be compensated. The first support 17 and the second support 18 are thus fastened, respectively, to each of the ends of the inner casing 12.

The casing 3*b* comprises a shoulder 19, on which the end of the inner casing 12 facing the compressor 2, in other words the end at which the motor 1 is coupled to the compressor 2, bears.

The housing 3*b* also comprises a cover 20 enabling the housing 3*b* to be sealed at an end through which the inner casing 12 is inserted into the housing 3*b*. The cover 20 is screwed into the bearing support 18. When the removable cartridge, comprising the inner casing 12 and the motor 1, has been coupled to the cover 20, it is inserted into the housing 3*b*. The cover 20 and the bearing support 18 are then held in position with the aid of a key member, for example a Circlip® 21 inserted into a groove 22 provided for this purpose in the housing 3*b*.

Thus, the arrangement shown in this first example makes it possible to provide a removable cartridge comprising the inner casing 12, the rotor 13, the stator 14, the cover 20, and the bearings 15 and 16 which are mounted, respectively, on the first support 17 and the second support 18, which are fixed to the inner casing 12. When the key member 21 and then the cover 20 have been withdrawn, the removable cartridge can thus be withdrawn for any necessary maintenance operation and can then be re-inserted into the housing without the need to remove other elements of the motor compressor unit.

The cover 20 also comprises an axial high-voltage wiring outlet 23. This axial outlet 23 is sealed in such a way that the interior of the housing 3 is kept pressurized during operation. The axial outlet 23, thus, allows the removable cartridge to be withdrawn without preliminary disconnection of wiring. In fact, once the Circlip® has been withdrawn, the cartridge can be extracted from the housing 3*b* without any need to remove the high-voltage wiring between the motor and the cover 20.

Additionally, the motor compressor unit also comprises an inlet for the supply of cooling gas. This gas supply, which is not shown, can be provided either radially through the housing 3*b* and the inner casing 12, or axially, in which case the cover 20 comprises an axial gas supply inlet.

Figure 3:
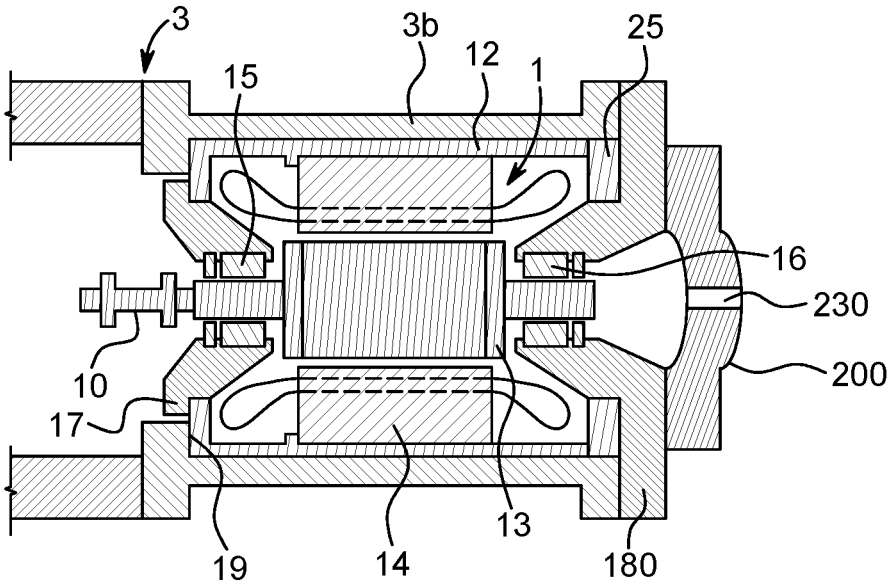
FIG. 3 shows part of a motor compressor unit with a removable cartridge according to one embodiment of the present invention.

FIG. 3 shows part of a motor compressor unit with a removable cartridge according to a second embodiment. Only the part of the housing 3 containing the motor 1, in this case the housing 3*b*, is shown in FIG. 3, the part of the motor compressor unit containing the compressor 2 being similar to that shown in FIG. 2.

Elements identical to the elements of the first embodiment shown in FIG. 2 have the same references.

In this example, the housing 3 comprises a second support 180 fastened to the housing 3*b* at an end through which the inner casing 12 is inserted, and the cover 190 is fastened by screwing to this second support 180. This attached support 180 is generally annular in shape and has an essentially central extension supporting a bearing 16 for the motor shaft. This second support 180 is also connected to the inner casing 12 by means of a semi-rigid fastening enabling the axial expansion of said inner casing to be compensated.

When the support 180 is detached from the housing 3*d*, the removable cartridge, comprising the inner casing 12, the rotor 13, the stator 14, the cover 20, and the bearings 15 and 16 which are mounted, respectively, on the first support 17 and the second support 180, can be withdrawn.

In this example, the cover 200 comprises an axial high-voltage wiring outlet 230. This axial outlet 230 is sealed in such a way that the interior of the housing 3 is kept pressurized during operation. The axial outlet 230, thus, allows the removable cartridge to be withdrawn without preliminary disconnection of wiring. In fact, the cartridge can be extracted from the housing 3*b* at the same time as the cover 200 without any need to remove the high-voltage wiring between the motor and the cover 200.

Additionally, the motor compressor unit also comprises an inlet for the supply of gas. This gas supply, which is not shown, can be provided either radially through the housing 3*b* and the inner casing 12, or axially, in which case the cover 200 comprises an axial gas supply inlet.

Figure 4:
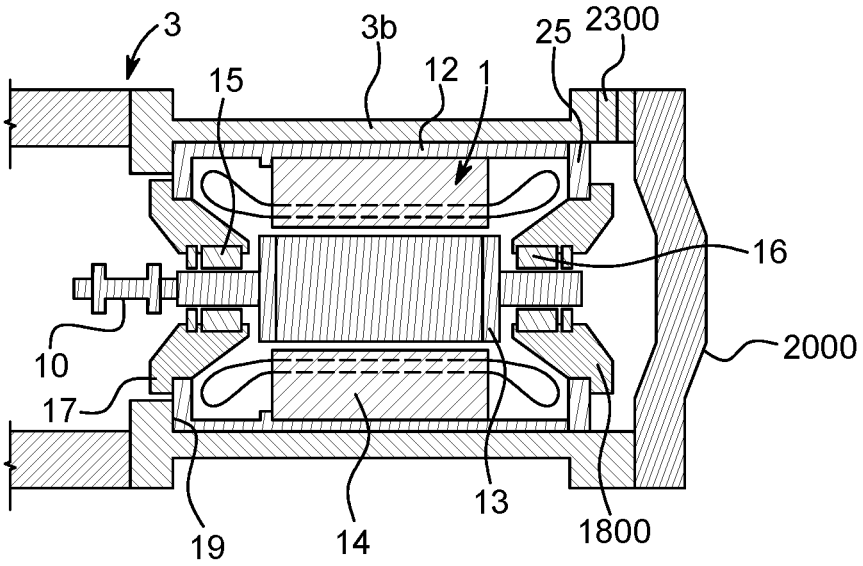
FIG. 4 shows part of a motor compressor unit with a removable cartridge according to one embodiment of the present invention.

FIG. 4 shows part of a motor compressor unit with a removable cartridge according to a third embodiment. Only the part of the housing 3 containing the motor 1, namely the housing 3*b*, is shown in FIG. 4. The part of the motor compressor unit containing the compressor 2 being similar to that shown in FIG. 2.

Elements identical to the elements of the first embodiment shown in FIG. 2 have the same references.

In this example, the housing 3*b* comprises a second support 1800 carrying the bearing 16 and fastened to an end of the inner casing 12 opposite to the end facing the compressor 2, and a cover 2000 fastened by screwing to an end of the housing 3 through which the inner casing 12 is inserted into the housing 3*b*.

In this example, the removable cartridge does not comprise the cover 2000, as the latter is in contact with the housing 3 only. Instead of being screwed on to the housing 3, the cover 2000 can be retained axially with respect to the housing 3 with the aid of a Circlip® inserted into a groove provided for this purpose in the motor casing 3*b*, on the same principle as that illustrated in FIG. 2.

In this example, the high-voltage wiring outlet is formed radially. For this purpose, the housing 3 comprises a sealed radial high-voltage wiring outlet passing through the housing 3. This radial outlet 2300 is sealed in such a way that the interior of the housing 3 is kept pressurized during operation. The internal connections are formed in such a way that the wiring can be cut between the sealed radial outlet 2300 and the removable cartridge when the removable cartridge is withdrawn.

Thus, during disassembly, the cover 2000 is first withdrawn, after which the wiring between the removable cartridge and the sealed radial outlet 2300 are disconnected at the internal connections provided for this purpose, and the removable cartridge is then extracted from the housing 3.

The motor compressor unit also comprises an inlet for the supply of gas. This gas supply, which is not shown, can be provided either radially through the housing 3*b* and the inner casing 12, or axially, in which case the cover 2000 comprises an axial gas supply inlet.

Although the present invention has been described with reference to particular embodiments, this description generally aims to set forth the inventive ideas and should not be taken to limit the scope of the present invention, and the scope of the present invention will be defined by the appended claims. Of course, those skilled in the art will also be appreciated that the present invention may be performed in other ways than those specifically described herein, without departing from the basic characteristics of the present invention. The present embodiments are thus to be considered in all respects as illustrative and not restrictive, and all changes which come within the meaning and range of equivalency of the appended claims are intended to included therein.

What is claimed is:

1. A motor compressor unit comprising:

a common housing sealed with respect to a gas to be compressed;

a motor mounted to the common housing;

a compressor mounted to the common housing; and a first bearing mounted on a first bearing support, the first bearing support mounted to a first end of an inner casing facing the compressor;

a second bearing mounted on a second bearing support, the second bearing support mounted to a second end of the inner casing, the second end of the inner casing located opposite the first end of the inner casing;

wherein the motor is mounted in the inner casing, wherein the inner casing, in entirety, is removably mounted in the common housing, and wherein the inner casing is held in position in the common housing by at least one removable fastening device configured to apply an axial force to seal the common housing.

2. The motor compressor unit according to claim 1, wherein the motor comprises a stator fixed to the inner casing.

3. The motor compressor unit according to claim 1, wherein the at least one removable fastening device comprises a key member located between the inner casing and the common housing.

4. The motor compressor unit according to claim 1, wherein the common housing comprises a shoulder on which the first end of the inner casing facing the compressor bears.

5. The motor compressor unit according to claim 1, further comprising a cover configured to seal the common housing at an end of the common housing through which the inner casing is inserted into the common housing, the cover being attached, by screwing, to the second bearing support.

6. The motor compressor unit according to claim 1, wherein the second bearing support is fastened to the common housing at an end of the common housing through which the inner casing is inserted into the common housing.

7. The motor compressor unit according to claim 1, wherein the inner casing is kept in position axially by keying, using a key member as the at least one removable fastening device, to the common housing at an end of the common housing through which the inner casing is inserted into the common housing.

8. The motor compressor unit according to claim 1, wherein a cover, configured to seal the common housing at an end of the common housing through which the inner casing is inserted into the common housing comprises a sealed axial wiring outlet.

9. The motor compressor unit according to claim 1, wherein a cover, configured to seal the common housing at an end of the common housing through which the inner casing is inserted into the common housing, comprises an axial gas supply inlet.

10. The motor compressor unit according to claim 1, further comprising a cover configured to seal the common housing at an end of the common housing through which the inner casing is inserted into the common housing, the cover being attached, by screwing, to the common housing.

11. The motor compressor unit according to claim 1, wherein the common housing comprises a sealed radial wiring outlet passing through the common housing.

12. The motor compressor unit according to claim 10, wherein the common housing comprises a sealed radial gas supply inlet passing through the common housing.

13. The motor compressor unit according to claim 1, wherein the compressor comprises a plurality of compression stages.

14. A motor compressor unit comprising:

a common housing sealed with respect to a gas to be compressed;

a motor mounted to the common housing;

a compressor mounted to the common housing; and at least one bearing support for the motor, the at least one bearing support fastened to an end of an inner casing opposite an end of the inner casing facing the compressor and in a manner that allows for axial expansion, wherein the motor is mounted in the inner casing, wherein the inner casing, in entirety, is removably mounted in the common housing, and wherein the inner casing is held in position in the common housing by at least one removable fastening device such that the motor and the inner casing form a removable cartridge.

* * * * *